US006425504B1

(12) United States Patent
Besser et al.

(10) Patent No.: US 6,425,504 B1
(45) Date of Patent: Jul. 30, 2002

(54) ONE-PIECE, COMPOSITE CRUCIBLE WITH INTEGRAL WITHDRAWAL/DISCHARGE SECTION

(75) Inventors: Matthew Besser, Urbandale; Robert L. Terpstra, Ames; Daniel J. Sordelet, Ames; Iver E. Anderson, Ames, all of IA (US); Alan D. Hartman; Edward R. Argetsinger, both of Albany, OR (US); Jeffrey S. Hansen, Corvallis, OR (US); Jack I. Paige, Albany, OR (US); Paul C. Turner, Independence, OR (US)

(73) Assignee: Iowa State University Research Foundation, Inc., Ames, IA (US)

( * ) Notice: Subject to any disclaimer, the term of this patent is extended or adjusted under 35 U.S.C. 154(b) by 0 days.

(21) Appl. No.: 09/481,033

(22) Filed: Jan. 11, 2000

Related U.S. Application Data

(63) Continuation-in-part of application No. 09/343,019, filed on Jun. 29, 1999.

(51) Int. Cl.[7] ..... B22D 41/08

(52) U.S. Cl. ..... 222/593; 222/590; 222/591; 266/275; 266/280; 164/457

(58) Field of Search ..... 266/202, 275, 266/280, 286, 45; 222/590, 591, 593; 164/46, 457

(56) References Cited

U.S. PATENT DOCUMENTS

| | | | | |
|---|---|---|---|---|
| 2,837,790 A | * | 6/1958 | Rozian | 164/457 |
| 4,877,705 A | * | 10/1989 | Polidor | 222/591 |
| 5,052,597 A | | 10/1991 | Bruckner | 222/593 |
| 5,125,574 A | | 6/1992 | Anderson et al. | 239/8 |
| 5,366,204 A | * | 11/1994 | Gigliotti, Jr. et al. | 266/202 |
| 5,589,199 A | * | 12/1996 | Anderson et al. | 266/202 |
| 5,939,016 A | | 8/1999 | Mathiesen et al. | 222/593 |

OTHER PUBLICATIONS

Ronald W. Smith and Richard Knight, "Thermal Spraying II: Recent Advances in Thermal Spray Forming," JOM (Apr. 19, 1996) pp. 16–18.

* cited by examiner

*Primary Examiner*—Scott Kastler

(57) ABSTRACT

A one-piece, composite open-bottom casting mold with integral withdrawal section is fabricated by thermal spraying of materials compatible with and used for the continuous casting of shaped products of reactive metals and alloys such as, for example, titanium and its alloys or for the gas atomization thereof.

14 Claims, 4 Drawing Sheets

ONE-PIECE, COMPOSITE CRUCIBLE WITH INTEGRAL WITHDRAWAL/DISCHARGE SECTION

This application is a continuation-in-part of Ser. No. 09/343 019 filed Jun. 29, 1999, now pending.

CONTRACTUAL ORIGIN OF INVENTION

The United States Government has rights in this invention pursuant to Contract No. W-7405-ENG-82 between the U.S. Department of Energy and Iowa State University, Ames, Iowa, which contract grants to the Iowa State University Research Foundation, Inc. the right to apply for this patent.

FIELD OF THE INVENTION

The present invention relates to casting of metals and alloys, and to casting vessels and methods.

BACKGROUND OF THE INVENTION

The high costs of titanium associated with its extraction, melting, fabrication, and quality control have severely limited titanium use for applications other than the aerospace industry and niche corrosion resistance applications. Nearly 50% of the cost of titanium can be attributed to fabrication costs. Currently, most wrought titanium products are derived from massive cylindrical ingot which must be broken down by multiple steps of forging and rolling.

Continuous casting of steels has been practiced for many years and involves pouring a stream of steel melt into an open-bottomed, water-cooled, permanent mold. The molten steel is solidified as it travels the length of the mold and is concurrently drawn out of the open bottom of the mold directly to rolling mills. However, direct transfer of steel continuous casting technology to the titanium industry is complicated because molten titanium is such a reactive metal relative to ceramic materials typically used to fabricate the melt handling components of a continuous casting system.

There is a need for ceramic melt handling components that are compatible with molten titanium and its alloys as well as other reactive metals/alloys that may be amenable to continuous casting. Compatibility includes not only the reduction of chemical reactivity between the melt handling components and the molten reactive metal/alloy but also the mitigation of thermal shock sensitivity which arises from the combination of rapid thermal stress gradient formation during casting and the inherent brittleness of common ceramic materials.

An object of the present invention is to satisfy this need.

SUMMARY OF THE INVENTION

The present invention provides in one embodiment a one-piece, composite, open-bottom melt containment vessel, having a crucible section and an integral withdrawal or discharge section, that is fabricated in a manner from materials that exhibit compatibility with a molten reactive metal or alloy, such as, for example, titanium and its alloys. In a particular embodiment, a one-piece, composite continuous casting mold has an open-bottom crucible section to contain the molten metal or alloy and an integral open-bottom tubular withdrawal section. The integrated crucible and withdrawal sections comprise an inner thermal sprayed melt-contacting layer that is selected to be compatible with the molten metal or alloy and an outer thermal sprayed back-up layer, the layers being thermal sprayed in a manner to impart thermal shock resistance to the integrated crucible and withdrawal sections. An induction coil is positioned about the open bottom crucible section to melt and/or heat the metal or alloy therein, while the withdrawal section is not actively heated so that molten metal or alloy is solidified as it travels the length of the withdrawal section for withdrawal of a shaped continuous cast product (e.g. bar, rod, etc.) from a lower open end of the withdrawal section.

The present invention provides in another embodiment a one-piece, composite open bottom melt holding vessel having an open-bottom crucible section to contain molten metal or alloy to be atomized and an integral open-bottom tubular molten metal or alloy discharge section proximate a gas atomizing nozzle. The integrated crucible and discharge sections comprise an inner thermal sprayed melt-contacting layer described above compatible with the molten metal or alloy and an outer thermal sprayed back-up layer, the layers being thermal sprayed in a manner to impart thermal shock resistance to the integrated crucible and discharge sections. The discharge section is positioned relative to the atomizing nozzle such that molten metal or alloy discharged from the discharge section is atomized to form powder.

The aforementioned objects and advantages of the present invention will become more readily apparent from the following detailed description taken with the following drawings.

DETAILED DESCRIPTION OF THE INVENTION

Figure 1:
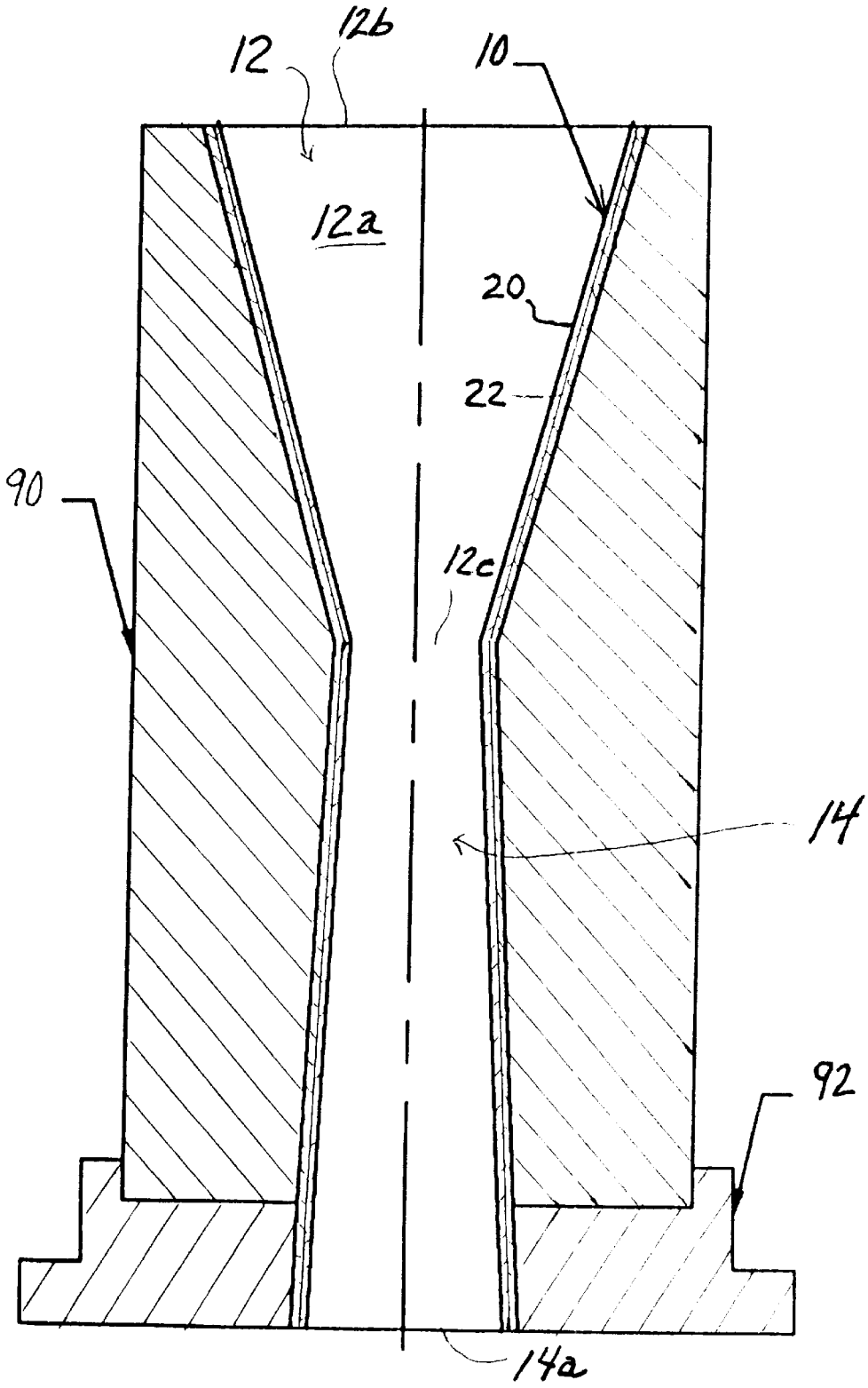
FIG. 1 is a longitudinal sectional view of a one-piece, composite open bottom continuous casting mold having a crucible section and integral tubular withdrawal section for continuous casting.

Referring to FIG. 1, a one-piece, composite continuous casting mold 10 is shown having an open-bottom crucible or receptacle section 12 and integral open-bottom tubular withdrawal (discharge) section 14 pursuant to an embodiment of the invention for continuous casting of titanium metal and its alloys, such as Ti-6Al-4V, Ti-8Al-1Mo-1V, TiAl, and others. The invention is not limited to continuous casting of titanium and its alloys, since other reactive metals and alloys that are reactive with ceramic melt handling components can be cast in the practice of the invention. For example, zirconium and its alloys, rare earth metals and alloys thereof, molybdenum and alloys thereof, and other metals and alloys reactive with ceramic melt handling components can be cast using the one-piece composite continuous casting mold 10.

The one-piece, composite continuous casting mold 10 is fabricated to include open-bottom crucible section 12 having a downwardly converging conical, funnel shaped crucible chamber 12*a* (e.g. funnel taper 17.8 degrees relative to vertical) to hold molten titanium or an alloy thereof, the chamber 12*a* including an open top 12*b* and open bottom 12*c*. The integral tubular withdrawal section 14 can include a circular, polygonal or other cross-sectional shape that tapers slightly outwardly (e.g. 0.85 degrees relative to vertical) in a downward direction to continuously cast metal/alloy products having the cross-sectional shape corresponding to that of the withdrawal section 14. For example, a cylindrical tubular withdrawal section 14 will produce a cylindrical continuous cast product (e.g. bar and rod) that can be withdrawn from the open bottom end 14*a* of the withdrawal section 14. With a polygonal withdrawal cross-section, square, C-beam, thin slab, and other cast products can be withdrawn from the open bottom end 14*a* of the withdrawal section 14.

The one-piece composite, open bottom continuous casting mold 10 is fabricated such that the crucible section 12 and integral withdrawal section 14 each include an inner thermal sprayed melt contacting refractory ceramic layer 20 that is selected to be compatible with the molten metal/alloy and an outer thermal sprayed layer 22, the layers 20, 22 being thermal sprayed in a manner to impart thermal shock resistance to the integrated crucible and withdrawal sections 12, 14. Compatibility or compatible as used herein includes not only a reduction of chemical reactivity of the continuous casting mold with the molten reactive metal/alloy but also the mitigation of mold thermal shock sensitivity which arises from the combination of rapid thermal stress gradient formation during casting. The layers 20, 22 can be thermal sprayed as taught in pending application Ser. No. 09/343,019 filed Jun. 29, 1999, the teachings of which are incorporated herein by reference.

For purposes of illustration only, for continuous casting of titanium and its alloys, the inner melt contacting layer 20 can comprise yttrium oxide while the outer layer 22 can comprise tungsten or other refractory metal such as tantalum, molybdenum and like metal or alloy that is compatible with the inner layer 20, has suitable refractory properties, and can be induction heated by suscepting to an electromagnetic field or electrically resistance heated as described in Ser. No. 09/343,019, the teachings of which are incorporated herein by reference. The outer layer 22 also can comprise a ceramic material such as yttria stabilized zirconia.

Figure 3A:
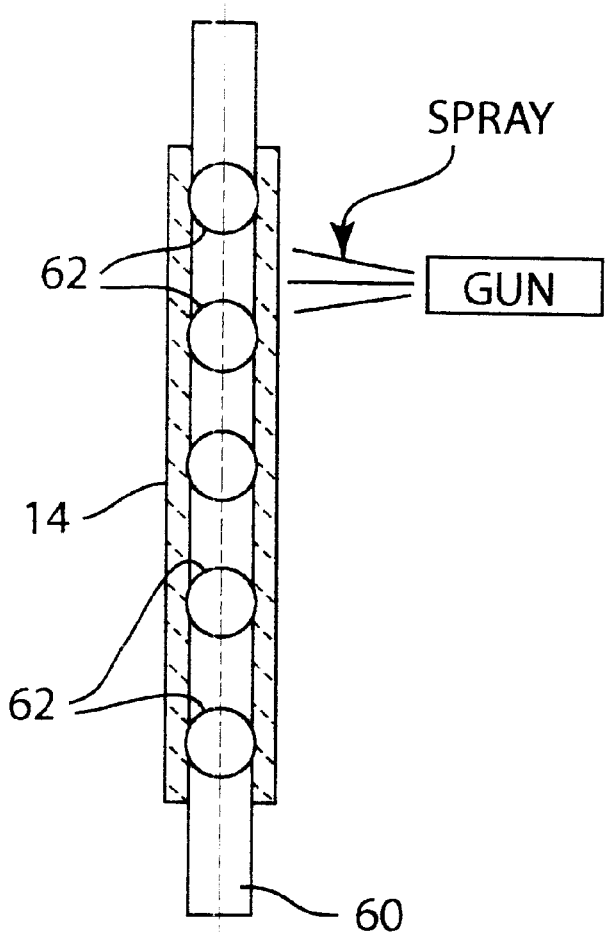
FIG. 3*a* is a schematic side view showing a plasma arc spray gun and cooling air jets for thermal spraying.
Figure 3B:
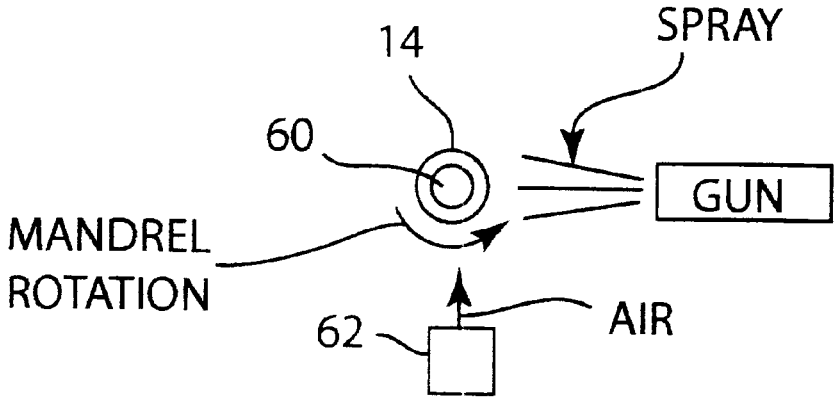
FIG. 3*b* is a schematic plan view thereof.

The one-piece, composite open bottom continuous casting mold 10 is made by thermally spraying suitable material on a fugitive mandrel 60, FIG. 3*a*, to deposit the inner layer 20 thereon. The fugitive mandrel is shown in FIGS. 3*a*, 3*b* as a simple cylinder for sake of convenience, the actual mandrel shape being a negative of the interior of the desired continuous casting mold 10. The fugitive mandrel 60 is machined or otherwise formed to have the configuration corresponding to a negative image of the mold 10. As a result, simple and complex continuous casting molds 10 can be formed. Moreover, the exterior configuration of the mold can be controlled by varying the thickness of the layers 20, 22 as desired along the length of the mandrel 60 by appropriately manipulating the thermal spraying device (e.g. a plasm spray gun).

The fugitive mandrel 60 then is selectively removed from the thermal sprayed inner layer 20. For example, if the mandrel is machined of graphite, the mandrel can be removed by heating the mandrel 60/layer 20 at 1000 degrees in air for a time to burn out the mandrel. Alternately, the mandrel can be selectively removed by chemical dissolution or attack, melting, vaporization or other removal technique depending upon the mandrel material used. Other mandrel materials that can be used include wood, copper, thermoplastics, salt and others. The mandrel can be formed to desired shape by machining, molding, casting, and other suitable forming method for the particular mandrel material used.

Thermal spraying of the inner melt-contacting layer 20 can be achieved using various thermal spraying techniques which direct a spray of molten or semi-molten or softened droplets of material at the mandrel and include conventional plasma arc spray (PAS) that involves electrically ionized carrier gas and ceramic powder feed material, high velocity oxygen fuel torch (HVOF) that involves a combustion of hydrogen or hydrocarbon fuel and oxygen and ceramic powder feed material, wire arc spray (WAS) that involves electric melting of wire or rod feed material, and other thermal spray techniques where finely divided ceramic material is deposited on the mandrel 60 in a molten or semi-molten or softened condition to form a spray deposit or layer. The mandrel typically is not preheated prior to beginning of the thermal spray operation. The mandrel typically is heated during formation of the inner layer 20 by the thermal spraying of molten or semi-molten ceramic material which solidifies and cools thereon, although the mandrel can be preheated if desired.

The outer layer 22 also can be thermally sprayed in the manner described above. The outer layer 22 is thermally sprayed onto the typically self-supporting inner layer 20 after removal of the fugitive mandrel 60, although the invention is not so limited. An optional ceramic third layer (see FIG. 4) can be thermally sprayed onto the layer 22 if desired using like thermal spraying techniques.

After the mold 10 is thermally sprayed in the above manner, it may be machined to length and external configuration by conventional machining practice used for brittle materials, such as for example, diamond grinding and sawing.

For fabricating the continuous casting mold 10 of FIG. 1, the mandrel comprised machined graphite as a negative of the mold shape desired. During thermal spraying, the mandrel was held in a rotating chuck (not shown) of an electric motor driven turntable in a vertical orientation and rotated at 300–400 rpm in the direction shown in FIG. 3*b* relative to a plasma spray arc gun GUN.

Thermal spraying of the continuous casting mold used yttrium oxide powders commercially available from Norton Ceramics, Worchester, Mass., having a particle size of greater than 10 and less 70 microns for inner layer 20 and tungsten powder commercially available from Praxair Surface Technologies having a particle size of greater than 45 and less 75 microns for outer layer 22.

Thermal spraying of yttrium oxide powder was conducted using a commercially available Praxair SG-100 plasma arc gun available from Praxair Surface Technologies, Indianapolis, Ind. and operated under the following configuration and parameters:

anode—Praxair part number 3083-145 cathode—Praxair part number 3083-129 gas injector—Praxair part number 3083-130 electrical current—900 amperes voltage at high frequency starter—43.6 Volts

Ar arc gas flow rate—37.8 slpm (standard liters/minute)

He auxiliary gas flow rate—20 slpm

Ar powder carrier gas flow rate—5.6 slpm powder feed rate—15 grams/minute spray distance (between gun and mandrel)—10 centimeters gun cooling air wand (Praxair part number 5004566) and cooling jets 62 total flow rate—1500 slpm The thermal spraying of the tungsten powder was conducted using the same plasma arc gun in FIGS. 3*a*, 3*b* operated under the same gun configuration and parameters with the exception of increased tungsten powder feed rate of 55 grams/minute.

The graphite mandrel was sprayed with vertical strokes of the spray gun until the inner layer 20 was deposited to a thickness of about 1.5 mm (typical thickness range of 1.25 to 1.5 mm). The mandrel with the inner layer 20 thereon was removed from the chuck and placed on a bed of yttrium oxide and heated to 1000 degrees C in air for several hours to burn out the graphite mandrel.

The resulting single yttrium oxide inner layer 20 was mounted on the chuck and plasma arc sprayed with tungsten as described above to form outer tungsten layer 22 thereon. Thermal spraying of the tungsten layer was conducted until a single tungsten layer thickness of about 1.5 mm (typical thickness range of 0.8 to 1.2 mm) was built up. The mold 10 then was machined to finished dimensions using a diamond saw. The inner diameter of the narrowest portion of the conical top mold chamber 12*a* was about 24.0 mm. The length of the lower withdrawal tube 14 was about 139.6 mm with an approximate exit inner diameter of about 26.7 mm.

During thermal spraying of the layers 20, 22, cooling air jets 62 spaced apart along the length of the mandrel, FIGS. 3*a* and 3*b*, discharged cooling air perpendicular to the axis of rotation of the mandrel to impact the deposited material after it splats on the mandrel or previously deposited material and deforms without interfering with molten or semi-molten particles before they strike the mandrel or previous deposit. Five such cooling air jets 62 were equally spaced apart along the length of the layers 20, 22 at a standoff distance of about 1.5 inches from the mandrel to establish overlapping cooling air jets on the layers 20, 22. The cooling jets 62 and the cooling wand of the plasma arc gun had a combined flow rate (total of all cooing jets plus the cooling wand) of 1500 slpm using filtered shop air. The cooling air jets were directed 90 degrees ahead of the plasma arc gun as shown in FIG. 3*b*. Suitable cooling air jets are available as Silvent nozzles from Silvent, 2920 Wolff Street, Racine, Wis. and can be spaced away from the mandrel within a typical range of 1 to 3 inches for example only depending upon particular spraying parameters and materials. Such high cooling gas flow rates rapidly cool the molten or semi-molten splats of deposited material (yttrium oxide or tungsten) to retain residual compressive stresses especially in the inner layer 20 but also in the outer layer 22 to mitigate thermal shock in the integrated sections 12, 14 in continuous casting service. The thermal sprayed layers 20, 22 are built up through a sequence of droplet solidification events which form a lamellar microstructure comprising high aspect ratio grains (flattened solidified droplets) of the deposited yttrium oxide ceramic or tungsten material. This layer microstructure produces a grain bridging effect and a network of isolated fine porosity to help resist propagation of cracks caused by thermal stress.

Figure 2:
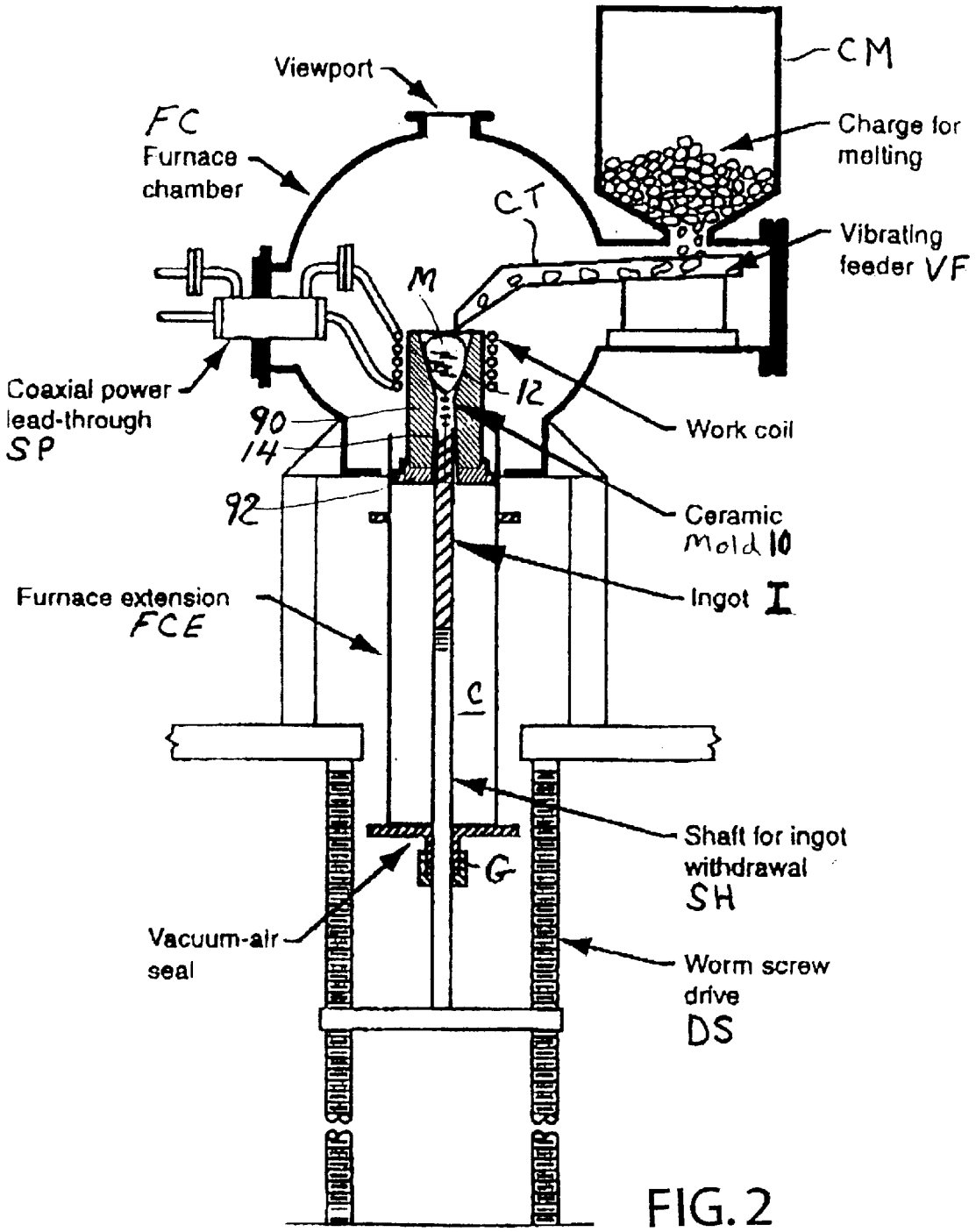
FIG. 2 is a schematic elevational view of continuous casting apparatus that includes the one-piece, composite open bottom continuous casting mold.

FIG. 2 illustrates a continuous casting machine of the general type described in U.S. Pat. No. 3,775,091, the teachings of which are incorporated herein by reference. The one-piece composite, open bottom continuous casting ceramic mold 10 described above was used in the continuous casting machine after the mold 10 was mounted in an optional graphite containment vessel 90 on a bottom support plate 92 which may be graphite also or other material, FIG. 1. The downwardly converging conical crucible chamber 12*a* of the crucible section 12 was surrounded in an induction coil IC while the lower downwardly diverging withdrawal section 14 was not surrounded by an induction coil so as not to be actively heated, whereby molten titanium was solidified as it traveled the length of the withdrawal section 14 for withdrawal of a shaped continuous cylindrical casting (rod or bar) from the open end 14*a* of the withdrawal section 14. A solid cylindrical titanium ingot with a slightly undersized diameter was placed at the midpoint of the withdrawal section 14 as a starting stub (plug). The bottom of the starting stub was drilled and tapped to allow attachment of a water cooled shaft SH of a withdrawal mechanism WD. As the induction field was increased, the graphite containment vessel (FIG. 1) and tungsten layer 22 act as the susceptor of the induction field to generate heat which was conducted through the inner layer 20 into the solid charge of titanium in the chamber 12*a*. As the titanium charge M was heated and melted in chamber 12*a*, the solidified cylindrical ingot I was withdrawn from the bottom of the withdrawal section 14, while fresh loose titanium charge material was continuously fed to the chamber 12*a*.

The vacuum tight aluminum furnace chamber FC was 76.2 cm long with a 76.2 cm diameter hinged door. The mold or crucible 10 was mounted in the bottom of the chamber with an additional 17.8 cm diameter long extension chamber FCE for ingot withdrawal. All flanges of the furnace were water-cooled and included o-ring seals. The furnace was installed on an elevated deck to facilitate ingot withdrawal.

The power supply SP to induction coil "work coil" was a 100 kW, 9600 Hz motor generator rated at 440 VAC and 228 Amps AC. The vacuum system consisted of a 1250 cfm rotary blower backed by a 140 cfm mechanical pump. The furnace chamber FC was evacuated to less than 50 millitorr and then backfilled with ⅕ atmosphere of an inert gas such a argon.

Titanium charge materials M (e.g. turnings of a Ti-6%Al-4%V alloy where % are by weight) for melting were placed in a 50.8 cm high chamber CM mounted on a 25.4 cm diameter extension to the right side of the furnace chamber. An additional feed chamber (not shown) could be added to the top of the original chamber for providing increased charge weight. The charge was gravity fed through a 7.6 cm diameter funnel shaped opening at the bottom of the chamber CM onto an electric vibratory feeder VF. The vibratory feeder delivered the charge material onto a chute CT extending over the edge of the mold or crucible 10 where the charge material fell into the mold or crucible 10. As the melting progressed and stabilized at a superheat of about 50–100 degrees C above the alloy melting point, the ingot I was withdrawn from about the mid-point of the unheated lower withdrawal section 14 of the mold to ensure solidification of at least an external solid shell before entering the withdrawal chamber C in the furnace. The water cooled shaft SH connected to the bottom of the starting plug extended through the bottom of the withdrawal chamber C via a vacuum gland G so that withdrawal of the ingot at a rate of 15.9 mm/minute was achieved by an electric motor (not shown) and worm drive screw mechanism DS. Loose titanium charge materials can comprise titanium briquettes, sponge, scrap and the like.

Figure 4:
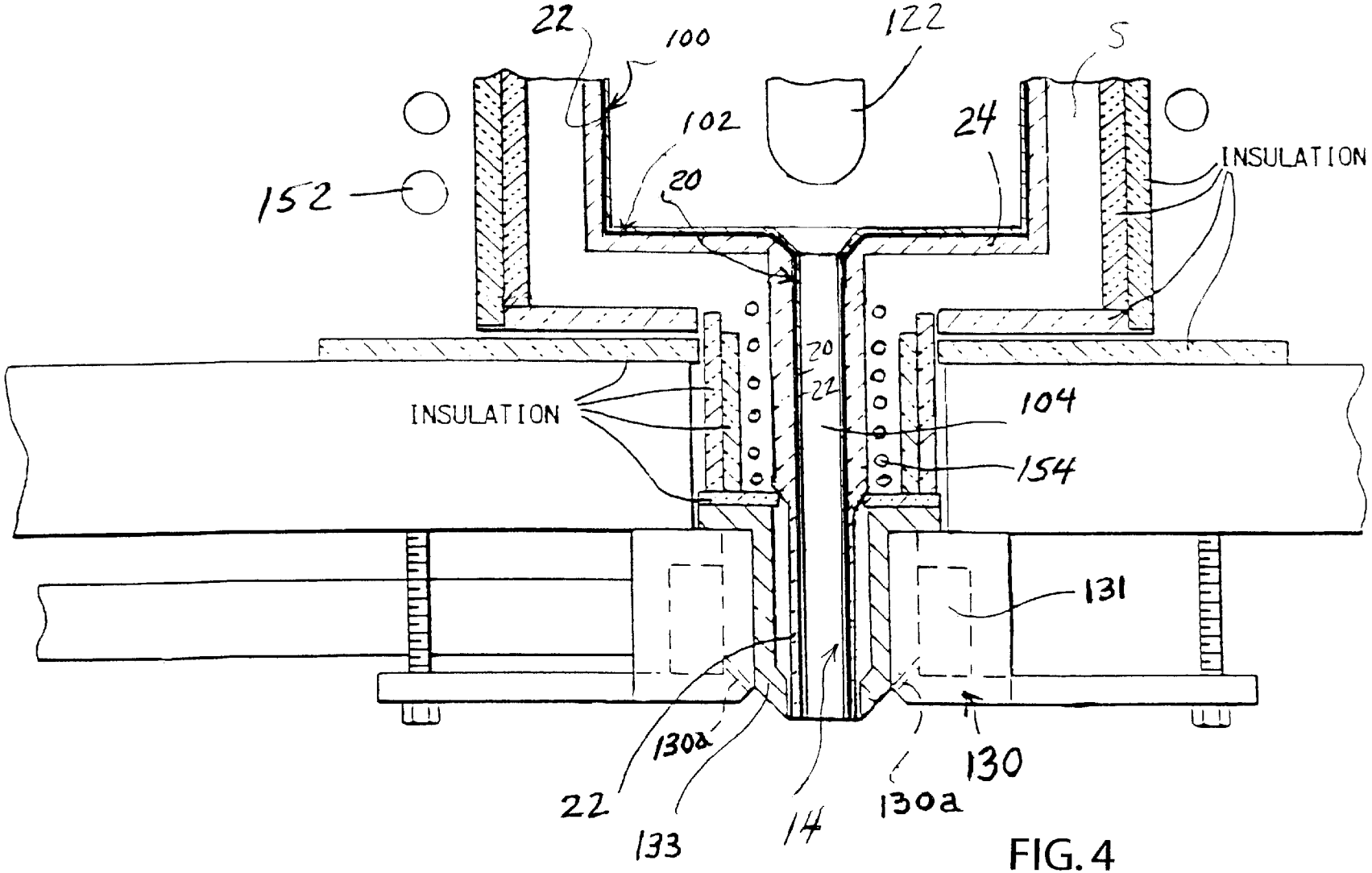
FIG. 4 is a sectional view of high pressure gas atomization apparatus including a one-piece, composite open-bottom crucible section to contain molten metal or alloy and-an integral tubular molten metal or alloy discharge section proximate an atomizer.

Referring to FIG. 4, another embodiment of the invention involves a one-piece, composite open bottom melt containment vessel or crucible 100 for use in a gas atomizing apparatus, for example, of the type described in U.S. Pat. Nos. 5,125,574 and 5,228,620, the teachings of which are incorporated herein by reference. The vessel or crucible 100 has an open-bottom crucible or receptacle section 102 to contain molten metal/alloy and an integral open-bottom tubular molten metal/alloy discharge section 104. The crucible section 102 and discharge section 104 comprise an inner thermal sprayed melt-contacting layer 20 like that described above compatible with the molten metal/alloy (e.g. yttrium oxide for titanium and its alloys), an intermediate thermal sprayed layer 22 (e.g. tungsten layer shown as thickened black line) and an optional outer refractory oxide thermal sprayed layer 24 that can comprise $ZrO_2$, for example only, the layers being thermal sprayed in the manner described above to impart thermal shock resistance to the integrated crucible and discharge sections and for thermal insulation of the nozzle. The discharge section 104 is positioned relative to gas discharge orifices 130*a* of an atomizing nozzle 130 so that molten metal/alloy discharged from the discharge section 104 is atomized to form powder. The gas discharge orifices 130 receive high pressure atomizing gas, such as argon, from manifold 131 as described in the above US patents. The discharge section 104 can be surrounded by a stainless steel tubular tip 133.

In use in the atomization apparatus of FIG. 4, induction coils 152, 154 inductively heat the intermediate tungsten layer 22 of the vessel or crucible 100 as the susceptor of the electromagnetic field of induction coils. Alternately, the intermediate tungsten layer 22 in the narrow tube section 14 can be electrical resistance heated by connecting to a suitable conventional furnace electric power supply (not shown). The induction coils 152, 154 can be separate from one another or integrated together. In FIG. 4, the induction coil 152 is arranged to inductively heat the containment vessel 90 and the intermediate tungsten layer 22 and melt the solid titanium charge in the crucible section 102, and the induction coil 154 is arranged to inductively heat intermediate tungsten layer 22 of the discharge section 104 to minimize cooling of the molten metal or alloy as it flows through the discharge section 104 to provide better temperature control of the melt before atomization and to prevent freeze up of the discharge section 104. Flow of the molten metal or alloy can be controlled by a stopper rod 122 and stopper rod seat disposed therebelow on the crucible section 102. Alternately, the stopper rod may be eliminated and a solid, meltable plug (not shown) can be placed in the discharge section 104 and melted at an appropriate time (when the molten metal or alloy is at a desired superheat temperature) to release the molten metal or alloy from the crucible section 102 for flow through the discharge section 104 to the atomizing nozzle 130. The crucible section 102 can be supported at the bottom and/or sides by additional refractory material (not shown), such as refractory lining, refractory wool, additional insulation members, and the like, disposed in space S between the crucible bottom and sides and the thermal insulation members shown in FIG. 4.

Rather than melting a solid charge in the crucible section 102, a solid charge can be melted in a separate melting vessel or crucible (not shown) and then poured into the one-piece composite crucible 102, which would serve as a tundish.

Although the invention has been described above with respect to certain embodiments, those skilled in the art will appreciate that the invention is not limited to these embodiments and that changes, modifications, and the like can be made therein without departing from the spirit and scope of the invention as set forth in the appended claims.

We claim:

1. Combination of a one-piece, composite continuous casting mold for casting molten meta or alloy, said mold having an open-bottom crucible section to contain the molten metal or alloy and an integral tubular open-bottom withdrawal section which is communicated to said crucible section and in which the molten metal or alloy is solidified, said crucible section and said withdrawal section comprising an inner thermal sprayed melt-contacting ceramic layer that is selected to be compatible with the molten metal or alloy and an outer thermal sprayed back-up layer, said layers being thermal sprayed to impart thermal shock resistance to said mold, and an induction coil positioned about said crucible section to heat the metal or alloy therein, while the molten metal or alloy is solidified as it travels along the withdrawal section for withdrawal of a shaped continuous casting from said withdrawal section.

2. The combination of claim 1 wherein said inner melt-contacting layer consists essentially of yttrium oxide and said outer layer comprises a refractory metal.

3. The combination of claim 1 wherein said crucible section includes a conical funnel shape communicating with said withdrawal section.

4. The combination of claim 3 wherein said withdrawal section has a circular or polygonal cross-section.

5. The combination of a one-piece, composite vessel having an open-bottom crucible section to contain molten metal or alloy and an integral tubular open-bottom discharge section, said crucible section and said discharge section comprising an inner thermal sprayed melt-contacting ceramic layer that is selected to be compatible with the molten metal or alloy and an outer thermal sprayed refractory layer, the layers being thermal sprayed to impart thermal shock resistance to the vessel, said discharge section being positioned relative to an atomizing nozzle such that molten metal or alloy is discharged from the discharge section for atomization to form powder.

6. The combination of claim 1 including said inner layer, a thermally sprayed intermediate layer and said outer layer.

7. The combination of claim 6 wherein said inner melt-contacting layer consists essentially of yttrium oxide, said intermediate layer comprises a refractory metal and said outer layer comprises a refractory oxide.

8. The combination of claim 5 wherein said crucible section includes a conical funnel shape communicating with said discharge section.

9. A one-piece, composite vessel having an open-bottom crucible section to contain molten metal or alloy and an integral open bottom, tubular withdrawal or discharge section with said crucible section and said withdrawal or discharge section comprising an inner thermal sprayed melt-contacting ceramic layer that is selected to be compatible with the molten metal or alloy and an outer thermal sprayed back-up layer, said layers being thermal sprayed to impart thermal shock resistance to said vessel.

10. The vessel of claim 9 wherein said inner melt-contacting layer consists essentially of yttrium oxide and said outer layer comprises at least one of a refractory metal and refractory oxide.

11. The vessel of claim 9 wherein said crucible section includes a conical funnel shape communicating with said withdrawal or discharge section.

12. A method of continuous casting of a reactive metal or alloy, comprising:

containing molten reactive metal or alloy in an actively heated region of open bottom crucible section of a one-piece, composite continuous casting mold comprising an inner thermal sprayed melt-contacting layer that is selected to be compatible with the molten metal or alloy and an outer thermal sprayed back-up layer, solidifying the molten metal or alloy in an integral withdrawal section of said mold proximate said crucible section and not actively heated, and withdrawing cast product from an open end of said withdrawal section remote from said crucible section.

13. A method of atomizing a reactive metal or alloy, comprising:

containing molten reactive metal or alloy in an actively heated region of open bottom crucible section of a one-piece, composite vessel comprising an inner thermal sprayed melt-contacting ceramic layer that is selected so be compatible with the molten metal or alloy and an outer thermal sprayed back-up layer, said layers being thermal sprayed to impart thermal shock resistance to said vessel, discharging the molten metal or alloy through a heated integral discharge section of said vessel proximate said crucible section, and atomizing the molten metal or alloy discharged from said discharge section.

14. The method of claim 13 wherein titanium or an alloy thereof is contained in said crucible section and discharged through said discharge section with said crucible section and discharge section having an inner melt-contacting layer consisting essentially of yttrium oxide.

* * * * *

UNITED STATES PATENT AND TRADEMARK OFFICE

CERTIFICATE OF CORRECTION

PATENT NO. : 6,425,504 B1 
DATED : July 30, 2002
INVENTOR(S) : Mathew F. Besser et al.

It is certified that error appears in the above-identified patent and that said Letters Patent is hereby corrected as shown below:

Column 7,
Line 6, replace “meta” with -- metal --.

Column 9,
Line 9, replace “so” with -- to --.

Signed and Sealed this

Thirty-first Day of December, 2002

JAMES E. ROGAN
*Director of the United States Patent and Trademark Office*